US005104502A

United States Patent [19]

Mussinelli

[11] Patent Number: 5,104,502

[45] Date of Patent: * Apr. 14, 1992

[54] CATHODIC PROTECTION SYSTEM AND ITS PREPARATION

[75] Inventor: Gian L. Mussinelli, Lomazzo, Italy

[73] Assignee: Oronzio De Nora S.A., Lugano, Switzerland

[ * ] Notice: The portion of the term of this patent subsequent to Nov. 5, 2008 has been disclaimed.

[21] Appl. No.: 644,825

[22] Filed: Jan. 23, 1991

Related U.S. Application Data

[63] Continuation-in-part of Ser. No. 452,561, Dec. 18, 1989, Pat. No. 5,062,934.

[51] Int. Cl.[5] ..... C23F 13/00

[52] U.S. Cl. ..... 204/147; 204/196; 204/284; 204/290 F

[58] Field of Search ..... 204/147, 196, 284, 290 F

[56] References Cited

U.S. PATENT DOCUMENTS

| | | | |
|---|---|---|---|
| 3,804,740 | 4/1974 | Welch | 204/290 F |
| 4,528,084 | 7/1985 | Beer et al. | 204/290 F |
| 4,708,888 | 11/1987 | Mitchell et al. | 204/196 |
| 4,855,024 | 8/1989 | Drachnik et al. | 204/284 |

*Primary Examiner*—T. Tung
*Attorney, Agent, or Firm*—Bierman and Muserlian

[57] ABSTRACT

A method of forming a grid for cathodically protecting a steel rebar reinforced concrete structure comprising forming on the surface of the concrete structure rows of a plurality of valve metal strips with voids, the said strips having an electrocatalytic surface and at least 200 nodes per square meter of concrete surface, providing valve metal strips optionally without voids at spaced intervals connected to the rows of strips with voids to form a grid electrode and covering the grid electrode with an ion conductive cementitious overlay and the structure prepared thereby.

20 Claims, 1 Drawing Sheet

CATHODIC PROTECTION SYSTEM AND ITS PREPARATION

PRIOR APPLICATION

This application is a continuation-in-part of U.S. patent application Ser. No. 452,561, filed Dec. 18, 1989, now U.S. Pat. No. 5,062,934.

STATE OF THE ART

Cathodic protection of said metal substrates is well known. The substrate is made the cathode in a circuit which includes a DC current source, an anode, and an electrolyte between the anode and the cathode. The exposed surface of the anode is made of a material which is resistant to corrosion, for example platinum on a valve metal substrate such as titanium or a dispersion of an organic polymer of carbon black or graphite. The anode can be a discrete anode, or it can be a distributed anode in the form of an elongated strip or a conductive paint. There are many types of substrate which need protection from corrosion, including steel reinforcing members in concrete, which are often referred to as "rebars". Most Portland Cement concrete is sufficiently porous to allow passage of oxygen and aqueous electrolyte through it. Consequently, salt solutions which remain in the concrete or which permeate the concrete from the outside, will cause corrosion of rebars in the concrete. This is especially true when the electrolyte contains chloride ions, as for example in structures which are contacted by the sea, and also in bridges, parking garages, etc. which are exposed to water containing salt used for deicing purposes or finally, when calcium chloride has been added to the mortar as an hydration accelerator.

The corrosion products of the rebar occupy a much larger volume than the metal consumed by the corrosion. As a result, the corrosion process not only weakens the rebar, but also, and more importantly, causes cracks and spalls in the concrete. It is only within the last ten or fifteen years that it has been appreciated that corrosion of rebars in concrete poses problems of the most serious kind, in terms not only of cost but also of human safety. There are already many reinforced concrete structures which are unsafe or unuseable because of deterioration of the concrete as a result of corrosion of the rebar, and unless some practical solution to the problem can be found, the number of such structures will increase dramatically over the next decade. Consequently, much effort and expense have been devoted to the development of methods for cathodic protection of rebars in concrete. However, the known methods yield poor results and/or involve expensive and inconvenient installation procedures.

For details of known methods of cathodic protection, reference may be made for example to U.S. Pat. Nos. 4,319,854 (Marzocchi), 4,255,241 (Kroon), 4,267,029 (Massarsky), 3,868,313 (Gay), 3,798,142 (Evans), 3,391,072 (Pearson), 3,354,063 (Shutt) 3,022,242 (Anderson), 2,053,314 (Brown) and 1,842,541 (Cumberland), U.K Patents No. 1,394,292 and 2,046,789 and Japanese Patents No. 35293/1973 and 48948/1978. The entire disclosures of each of the patents and applications listed above are incorporated herein by reference.

British patent application No. 2,175,609 describes an extended area electrode comprising a plurality of wires in the form of an open mesh provided with an anodically active coating which may be used for the cathodic protection of steel rebars in reinforced concrete structures.

U.S. Pat. No. 4,708,888 describes a cathodic protection system using anodes comprising a continuous highly expanded valve metal mesh provided with a pattern of substantially diamond shaped voids having LWD and SWD dimensions for units of the pattern, the pattern of voids being defined by a continuum of thin valve metal strands interconnected at nodes and carrying on their surface an electrocatalytic coating. The mesh is made from highly expanded valve metal sheets, i.e. more than 90% or by weaving valve metal wire to form the same. However, the electrodes of this patent have only 500 to 2,000 nodes per square meter which means the anode is greatly expanded. The strands of the said U.S. Patent and the British Patent application No. 2,175,609 are subject to easy breakage resulting in areas of no current density where rebars are unprotected and areas of increased concentration of current density. Moreover, there is no means of varying the current density to accommodate different steel surface densities.

OBJECTS OF THE INVENTION

It is an object of the invention to provide a novel cathodic protection system for rebars in concrete structures wherein the current discharge can be varied according to the density of the steel rebars to avoid underprotection and/or overprotection areas.

It is another object of the invention to provide an improved grid electrode with a variable anodic surface for uniform current distribution according to steel surface density and an improved cathodic protected concrete structure per se.

It is a further object of the invention to provide a method of preparing a grid electrode system to provide cathodic protection to steel rebar concrete structures and the structures per se.

These and other objects and advantages of the invention will become obvious from the following detailed description.

THE INVENTION

The novel method of the invention for the formation of a grid for cathodically protecting a steel rebar reinforced concrete structure comprises forming on the surface of the concrete structure rows of a plurality of valve metal strips with voids, and an electrocatalytic surface, said strips having width and distance between such that the nodes per square meter of concrete surface is at least 200. By nodes, it is intended the connecting metal section about the voids of the strips. It further comprises providing valve metal strips optionally without voids at spaced intervals connected to the rows of strips with voids to form a grid electrode and covering the grid electrode with an ion conductive cementitious overlay. The voids in the valve metal strips may be formed by punching holes in the valve metal strips but the more economical method is to use expanded valve metal strips with an expansion of up to 75%.

Examples of valve metals are titanium, tantalum, zirconium and niobium, with titanium being preferred because of its strength, corrosion resistance and its ready availability and cost. The valve metals may also be used in the form of metal alloys and intermetallic mixtures.

The strips may be formed in a variety of ways. For example, a coil of a sheet of a valve metal of appropriate thickness is passed through an expanding apparatus and the expanded titanium is then cut into strips of the desired width. The strips can then be coated with an electrocatalytic surface by known methods. In a variation of the process, the electrocatalytic coating may be applied to the surface of the expanded valve metal mesh as it exits from the expanding apparatus and it is then cut into strips.

Such electrocatalytic coating have typically been developed for use as anodic coatings in the industrial electochemical industry and suitable coatings of this type have been generally described in U.S. Pat. Nos. 3,265,526; 3,632,498; 3,711,385 and 4,528,084, for example. The mixed metal oxide coatings usually include at least one oxide of a valve metal with an oxide of a platinum group metal including platinum, palladium, rhodium, iridium and ruthenium or mixtures of themselves and with other metals. It is preferred for economy that low load electrocatalytic coatings be used such as have been described in the U.S. Pat. No. 4,528,084, for example.

Among the preferred coatings are the dimensionally stable anodes wherein the coating consists of a valve metal oxide and a platinum group metal oxide and most preferably, a mixture of titanium oxide and ruthenium oxide. Another preferred coating is a cobalt spinel coating. In some installations, there can be provided a platinum and iridium metal interlayer between the substrate and the outer layer.

The valve metal, either in the form of expanded metal sheet or expanded metal strips, is first cleaned by suitable means such as solvent-degreasing and/or pickling and etching and/or sandblasting, all of which are well known techniques. The coating is then applied in the form of solutions of appropriate salts of the desired metals and drying thereof. A plurality of coats is generally applied but not necessarily and the strips are then dried to form the metal and/or metal oxide electrocatalytic coating.

Typical curing conditions for the electrocatalytic coating can include cure temperatures of from about 300° C. to about 600° C. Curing times may vary from only a few minutes for each coating layer up to an hour or more, e.g. a longer cure time after several coating layers have been applied. The curing operation can be any of those that may be used for curing a coating on a metal substrate. Thus, oven curing, including conveyor ovens may be utilized. Moreover, infrared cure techniques can be useful. Preferably, for most economical curing, oven curing is used and the cure temperature used will be within the range of from about 450° C. to about 550° C. At such temperatures, curing times of only a few minutes, e.g. from about 3 to 10 minutes, will most always be used for each applied coating layer.

The novel method of the invention for cathodically protecting steel reinforced concrete structures comprises impressing a constant anodic current upon grid electrodes comprising a plurality of valve metal strips with voids with an electrocatalytic surface and preferably at least 200, more preferably at least 2,000 nodes per square meter connected at spaced intervals with valve metal strips optionally without voids embedded in a steel reinforced concrete structure containing 0.5 to 5 square meters of steel surface to each square meter of concrete surface with the ratio of electrode surface to the steel surface being selected to maintain a uniform cathodic protection current density throughout the concrete structure. Nodes refer to the connecting metal sections about the voids. The uniform cathodic protection current density throughout the structure is achieved by varying the electrode surface to conform to the density of the steel rebar density which will vary throughout the structure, i.e. more steel rebars where a roadway is supported by pillars.

The electrode surface may be varied by varying the dimensions of the valve metal strips and/or varying the degree of voids or expansion of the valve metal strips and/or varying the spacing of the valve metal strips. This variation of the electrode surface with the density of the steel rebars ensures a constant uniform current distribution to obtain maximum anode life and effective cathodic protection of the steel rebars.

This ability to vary the electrode surface to match the rebar density prevents problems occuring in known cathodic protection systems such as that in U.S. Pat. No. 4,708,888. In the said patent, the electrode system can not be varied and therefore in areas where the rebar density is high, the cathodic protection current density is low resulting in insufficient protection of the steel surface and hence, steel corrosion. On the contrary, if one increases the anode current output to protect the higher rebar density areas, the anodic current density will be higher, resulting in shortened anode life and high electrolyte resistance due to the drying of the concrete (i.e. no electrolyte) near the anode. When the steel density is too low, the current density on the steel rebar is high, resulting in excessive alkalinity at the steel rebar surface and even hydrogen embrittlement in prestressed structures.

The invention has the advantage of allowing one to fine tune the current discharge to the reinforced concrete structure to protect the same from corrosion. Varying the dimension of the grid, varying the dimension of the strips and varying the degree of the expansion of both the strips and the anodic structure provide the possibility of varying the current discharge in a non-homogeneous manner to fit the need of the reinforced concrete structure. For example, because of the varying density of the reinforced steel rebars, the current discharge may vary from point to point of the concrete structure to avoid over or under protection.

This latter feature can be easily obtained by Applicants' system by welding the expanded valve metal strips at varying distances from each other or welding the expanded strips of different shapes and/or different degrees of expansion and the anodic structure can be fabricated in grid panels of varying dimensions to fit the needs of each individual structure. The successive welding of conductive bars to the mesh can be obtained by simply substituting one expanded valve metal strip with a plain one in the grid. The dimensions of the strips and spaces between them can be optimized for a given current output, thus obtaining the minimum weight of valve metal substrate used per square meter of concrete.

The dimensions of the strips with voids may vary from a width of 3 mm to 100 mm with a thickness of 0.25 mm to 2.5 mm and a length from one meter to 10 meters but these are merely preferred dimensions and the valve metal strips are preferably welded at 90° angles to each other but other angles are possible. The sides of the grid can either be quadrangular, rectangular or rhomboidal.

The current density delivered by the anodic structure to the reinforced concrete structure can vary depending upon the geometry of the grid panel, the degree of expansion of the strips and the dimensions of the strips. However, the preferred current density is between 2.5 to 50 mA per square meter of concrete. Again, this can be varied as well.

The structure of the anode of the invention, wherein the main openings of the grid are delimited by expanded metal strips instead of wires or strands of the prior art, allows for obtaining a further feature.

In fact, the concrete/anode contact area is distributed along the length and width of the strips preventing any harmful current flow concentration. By keeping the electric current in a "diluted" form in the concrete even in close proximity to the anode surface, the following advantages are obtained which favorably affect practical operation: lower ohmic drops, which allow for a higher current output with the same applied voltage; lower rate of oxygen production at the anode/concrete interface, which fact, together with the open mesh structure of the strips, prevents formation of gas pockets and acidity build up as well capable of interrupting the electric continuity of the circuit; lower wear rate of the coating, especially important when long life anodes are required, still having a low-cost, low noble metal loading coating.

In the prior art anodes, the anode/concrete contact area is represented by the tiny surface of each wire or strand delimiting each main opening. As a consequence, the electric current concentrates close to the anode/-concrete interface with all the troubles connected to higher ohmic drops and lower current output, formation of oxygen pockets, and high wear-rate of the coating which can be easily imagined by any expert in the field.

The process of forming the grid electrode of the invention comprises laying on site the valve metal strips with voids, preferably parallel to each other, on the concrete structure to be protected, connecting the said strips with voids with valve metal strips optionally without voids at spaced intervals to form the grid electrode, i.e. by welding, and then covering the grid electrode with an ion conductive cementitious overlay.

Referring now to the drawings.

Figure 1:
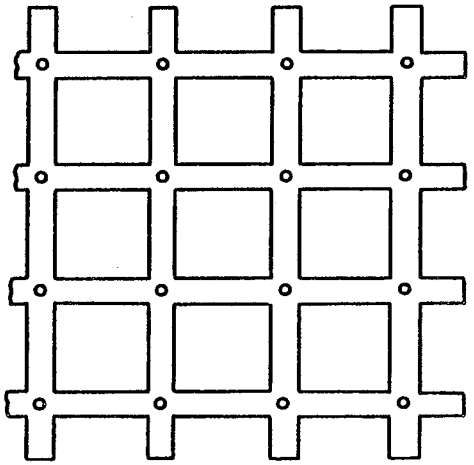
FIG. 1 is an example of one possible embodiment of a grid electrode of the invention and FIG. 2 is an expanded view of partial section of the embodiment of FIG. 1.
Figure 2:
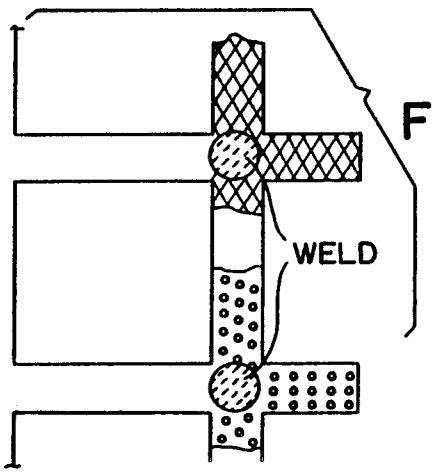

FIGS. 1 and 2 illustrate a preferred grid electrode of the invention using valve metal strips with voids 8 mm wide and 0.5 mm thick welded together to form a grid with a length of 250 mm. Such an anodic structure has an anodic contact surface of about 0.15 square meter per square meter of concrete and discharge about 15 mA per square meter of concrete. FIG. 2 shows the grid electrode with expanded metal strips and illustrates the welding points to hold the strips together.

Figure 3:
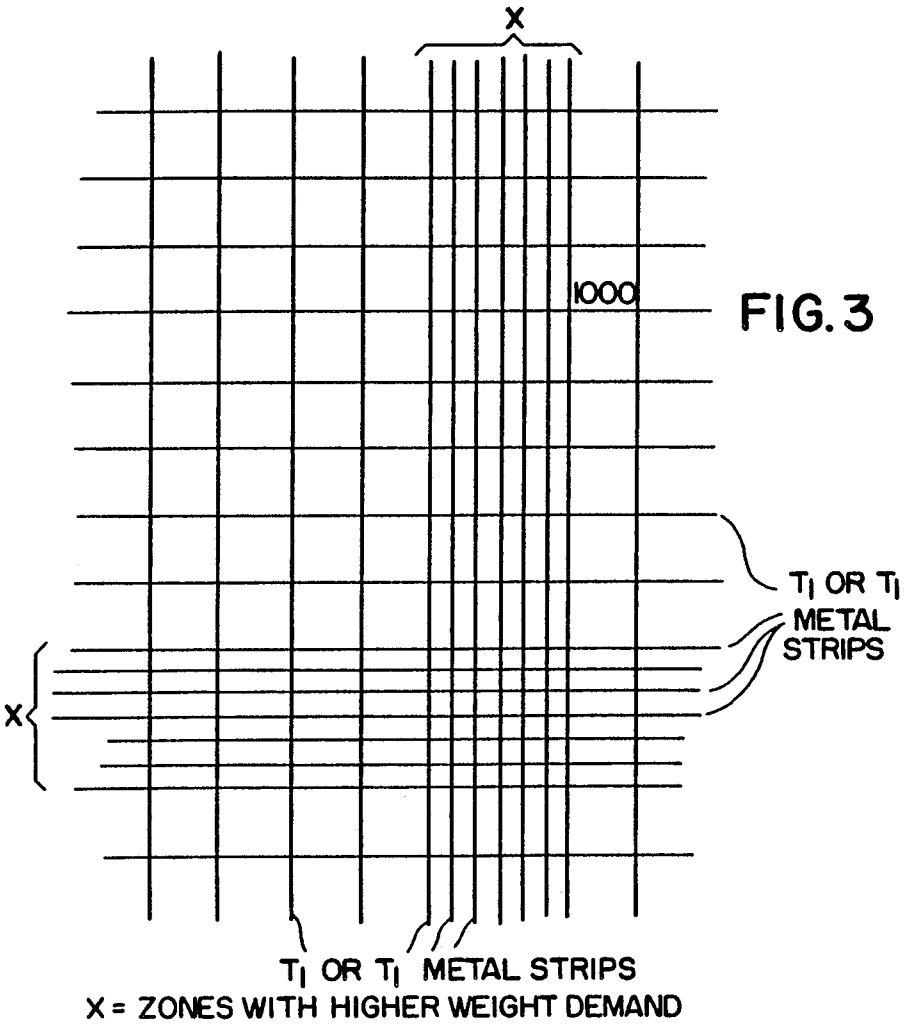
FIG. 3 is a plan view of a grid electrode of varying electrode surfaces to compensate for difference in density of the steel rebars in the concrete structure.

FIG. 3 illustrates the layout of the anode strips with voids to compensate for differences in the density of the concrete rebars so that there are zones of varying cathodic protection current density which conforms to the rebar density. The system of FIG. 3 can be used to fine tune the current discharge across the surface of the reinforced concrete structure to be protected to provide a very advantageous cathodic protection system. It is known that in all reinforced concrete structures, the density of the reinforcing bar varies with the location. In addition in prestressed reinforced concrete structures, it is possible to avoid the problem of overprotection caused by the prior art systems in zones with low rebar density. Overprotection results in hydrogen embrittlement of the concrete rebars thereby weakening the structure.

The grid electrode of the invention may comprise panels of variable dimensions. In particular for a horizontal concrete structure such as a bridge deck or a garage deck, the grid electrode can have a width of 0.5 to 3 meters with a length of 10 to 100 meters.

Various modifications of the grid electrodes and the cathodic protection method of the invention can be made without departing from the spirit or scope of the invention and it is to be understood that the invention is intended to be limited only in accordance with the appended claims.

What is claimed is:

1. A method of forming a grid electrode for cathodically protecting a steel rebar reinforced concrete structure comprising forming on the surface of a concrete structure rows of valve metal strips each with an electrocatalytic surface, each of said strips having voids and nodes, said nodes being at least 2000 nodes per square meter of concrete surface, connecting valve metal strips at spaced intervals to the rows of valve metal strips with voids to form a grid electrode and covering the grid electrode with an ion conductive coating.

2. The method of claim 1 wherein the valve metal strips connected to the strips with voids also have voids therein.

3. The method of claim 2 wherein the valve metal strips with voids are strips of expanded valve metal mesh.

4. The method of claim 2 wherein the electrode surface across the grid is varied by at least one means of the group consisting of strips of varying dimensions, strips of varying voids and strips of different spacing to vary the current density over the electrode surface.

5. The method of claim 2 wherein the electrocatalytic surface is a cobalt spinel coating.

6. The method of claim 5 wherein there is an intermediate layer of platinum group metals between the valve metal strip and the cobalt spinel coating.

7. The method of claim 2 wherein the electrocatalytic surface is a coating containing a platinum group metal oxide.

8. The method of claim 2 wherein the electrocatalytic surface is a mixed metal oxide coating.

9. The method of claim 8 wherein the mixed metal oxide includes at least one oxide of a valve metal selected from the group consisting of titanium and tantalum and a second oxide of a platinum group metal oxide selected from the group consisting of platinum oxide, palladium oxide, rhodium oxide, iridium oxide and ruthenium oxide and mixtures thereof.

10. The method of claim 2 wherein the concrete structure contains 0.5 to 5 square meters of steel rebar surface for each square meter of concrete surface and the ratio of electrode surface to steel surface is selected to maintain a uniform cathodic protection current density throughout the concrete structure.

11. The method of claim 10 wherein the uniform cathodic current density is achieved by varying the electrode surface by at least one means of the group consisting of using strips of different dimensions, strips of varying voids and different spacing of strips to conforms to the steel surface.

12. A concrete structure produced by the method of claim 10.

13. The structure of claim 12 wherein a uniform cathodic current density is achieved by varying the electrode surface by at least one means of the group consisting of using strips of different dimensions, strips of varying voids and different spacing of strips to conform to the density of the steel rebar density.

14. A concrete structure produced by the method of claim 2.

15. A method of cathodically protecting a steel rebar reinforced concrete structure of claim 11 comprising impressing a constant anodic current upon the grid electrode.

16. The method of claim 15 wherein the current density is 2.5 to 50 milliamperes per square meter of concrete structure.

17. The method of claim 15 wherein the concrete structure is that of claim 12.

18. The method of claim 15 wherein the concrete structure is that of claim 13.

19. A grid electrode comprising rows of valve metal strips each with an electrocatalytic surface, each of said strips having voids and nodes, the nodes being at least 2000 nodes per square meter and valve metal strips connected at spaced intervals to the valve strips with voids.

20. The grid electrodes of claim 19 wherein the valve metal strips connected to the strips with voids also are provided with voids.

* * * * *

UNITED STATES PATENT AND TRADEMARK OFFICE

CERTIFICATE OF CORRECTION

PATENT NO. : 5,104,502

DATED : April 14, 1992

INVENTOR(S) : G.L. MUSSINELLI

It is certified that error appears in the above-indentified patent and that said Letters Patent is hereby corrected as shown below:

Column 7, line 15, change "11" to --12--

Signed and Sealed this

Twenty-ninth Day of August, 1995

*Attest:*

Bruce Lehman

BRUCE LEHMAN

*Attesting Officer*

*Commissioner of Patents and Trademarks*